US008212845B2

(12) United States Patent
Lee et al.

(10) Patent No.: US 8,212,845 B2
(45) Date of Patent: Jul. 3, 2012

(54) LIQUID CRYSTAL DISPLAY DEVICE AND DRIVING METHOD THEREOF

(75) Inventors: Jeong Geun Lee, Daegu (KR); Han Seop Kim, Gumi-si (KR); Han Yung Jung, Daegu (KR)

(73) Assignee: LG Display Co., Ltd., Seoul (KR)

( * ) Notice: Subject to any disclaimer, the term of this patent is extended or adjusted under 35 U.S.C. 154(b) by 402 days.

(21) Appl. No.: 12/638,883

(22) Filed: Dec. 15, 2009

(65) Prior Publication Data

US 2010/0289828 A1 Nov. 18, 2010

(30) Foreign Application Priority Data

May 13, 2009 (KR) ..... 10-2009-0041900

(51) Int. Cl.
*G09G 5/10* (2006.01)

(52) U.S. Cl. ..... 345/690

(58) Field of Classification Search ..... 345/690, 345/209, 214, 99, 96, 89, 32, 10
See application file for complete search history.

(56) References Cited

U.S. PATENT DOCUMENTS 5,337,408 A * 8/1994 Fung et al. ..... 345/10
6,538,631 B1 * 3/2003 Kwon ..... 345/96
6,577,293 B1 * 6/2003 Kwon ..... 345/89
6,999,106 B2 * 2/2006 Huang ..... 345/690
7,012,600 B2 * 3/2006 Zehner et al. ..... 345/214
7,145,520 B2 * 12/2006 Ramanujan ..... 345/32
7,312,794 B2 * 12/2007 Zehner et al. ..... 345/214
7,889,168 B2 * 2/2011 Yamazaki et al. ..... 345/99
7,932,884 B2 * 4/2011 Song et al. ..... 345/96
2008/0158266 A1 * 7/2008 So ..... 345/690
2008/0192072 A1 * 8/2008 Park ..... 345/690
2008/0291189 A1 * 11/2008 Song et al. ..... 345/209
2009/0179923 A1 * 7/2009 Amundson et al. ..... 345/690

* cited by examiner

*Primary Examiner* — Fred Tzeng
(74) *Attorney, Agent, or Firm* — Birch, Stewart, Kolasch & Birch, LLP

(57) ABSTRACT

An LCD device includes: a liquid crystal panel configured to include liquid crystal cells formed in regions defined by crossing gate lines and data lines; an image analyzer configured to analyze whether or not an image data corresponds to a specific pattern in which a black or white gray-scale data having a large difference between positive and negative data voltages is continuously opposed to the liquid crystal cells of a vertical direction; a polarity control signal modulator configured to respond to a control signal from the image analyzer and modulate a polarity control signal, so as to prevent the black gray-scale data continuously opposed to the liquid crystal cells of the vertical direction from being polarity-inverted; and a data driver configured to apply the data voltages to the data lines on the basis of the modulated polarity control signal applied from the polarity control signal modulator.

10 Claims, 9 Drawing Sheets

H2D & V2D

| | | | | | | | |
|---|---|---|---|---|---|---|---|
| + | + | − | − | + | + | − | − |
| + | + | − | − | + | + | − | − |
| − | − | + | + | − | − | + | + |
| − | − | + | + | − | − | + | + |
| + | + | − | − | + | + | − | − |
| + | + | − | − | + | + | − | − |
| − | − | + | + | − | − | + | + |
| − | − | + | + | − | − | + | + |

| | | | | | | | | |
|---|---|---|---|---|---|---|---|---|
| B | B | B | B | B | B | B | B | L1 |
| B | B | B | B | B | B | B | B | L2 |
| B | B | B | B | B | B | B | B | L3 |
| W | W | W | W | W | W | W | W | L4 |
| W | W | W | W | W | W | W | W | L5 |
| W | W | W | W | W | W | W | W | L6 |
| B | B | B | B | B | B | B | B | L7 |
| B | B | B | B | B | B | B | B | L8 |

| | | | | | | | | |
|---|---|---|---|---|---|---|---|---|
| B | B | B | B | B | B | B | B | L1 |
| B | B | B | B | B | B | B | B | L2 |
| B | B | B | B | B | B | B | B | L3 |
| W | W | W | W | W | W | W | W | L4 |
| W | W | W | W | W | W | W | W | L5 |
| W | W | W | W | W | W | W | W | L6 |
| B | B | B | B | B | B | B | B | L7 |
| B | B | B | B | B | B | B | B | L8 |

H2D & V2D

| | | | | | | | |
|---|---|---|---|---|---|---|---|
| + | + | − | − | + | + | − | − |
| + | + | − | − | + | + | − | − |
| − | − | + | + | − | − | + | + |
| − | − | + | + | − | − | + | + |
| + | + | − | − | + | + | − | − |
| + | + | − | − | + | + | − | − |
| − | − | + | + | − | − | + | + |
| − | − | + | + | − | − | + | + |

H2D & V3D

| | | | | | | | |
|---|---|---|---|---|---|---|---|
| + | + | − | − | + | + | − | − |
| + | + | − | − | + | + | − | − |
| + | + | − | − | + | + | − | − |
| − | − | + | + | − | − | + | + |
| − | − | + | + | − | − | + | + |
| − | − | + | + | − | − | + | + |
| + | + | − | − | + | + | − | − |
| + | + | − | − | + | + | − | − |

FIG. 11

| | | | | | | | | | | | | | | | | |
|---|---|---|---|---|---|---|---|---|---|---|---|---|---|---|---|---|
| B | B | B | B | B | B | B | B | B | B | B | B | B | B | B | B | L1 |
| B | B | B | B | B | B | B | B | B | B | B | B | B | B | B | B | L2 |
| B | B | B | B | B | B | B | B | B | B | B | B | B | B | B | B | L3 |
| W | W | W | W | W | W | W | W | W | W | W | W | W | W | W | W | L4 |
| W | W | W | W | W | W | W | W | W | W | W | W | W | W | W | W | L5 |
| W | W | W | W | W | W | W | W | W | W | W | W | W | W | W | W | L6 |
| B | B | B | B | B | B | B | B | B | B | B | B | B | B | B | B | L7 |
| B | B | B | B | B | B | B | B | B | B | B | B | B | B | B | B | L8 |
| B | B | B | B | B | B | B | B | B | B | B | B | B | B | B | B | L9 |
| W | W | W | W | W | W | W | W | W | W | W | W | W | W | W | W | L10 |
| W | W | W | W | W | W | W | W | W | W | W | W | W | W | W | W | L11 |
| W | W | W | W | W | W | W | W | W | W | W | W | W | W | W | W | L12 |
| B | B | B | B | B | B | B | B | B | B | B | B | B | B | B | B | L13 |
| B | B | B | B | B | B | B | B | B | B | B | B | B | B | B | B | L14 |
| B | B | B | B | B | B | B | B | B | B | B | B | B | B | B | B | L15 |
| W | W | W | W | W | W | W | W | W | W | W | W | W | W | W | W | L16 |

FIG.12

H2D & V2D

| | | | | | | | | | | | | | | | |
|---|---|---|---|---|---|---|---|---|---|---|---|---|---|---|---|
| + | + | − | − | + | + | − | − | + | + | − | − | + | + | − | − |
| + | + | − | − | + | + | − | − | + | + | − | − | + | + | − | − |
| − | − | + | + | − | − | + | + | − | − | + | + | − | − | + | + |
| − | − | + | + | − | − | + | + | − | − | + | + | − | − | + | + |
| + | + | − | − | + | + | − | − | + | + | − | − | + | + | − | − |
| + | + | − | − | + | + | − | − | + | + | − | − | + | + | − | − |
| − | − | + | + | − | − | + | + | − | − | + | + | − | − | + | + |
| − | − | + | + | − | − | + | + | − | − | + | + | − | − | + | + |
| + | + | − | − | + | + | − | − | + | + | − | − | + | + | − | − |
| + | + | − | − | + | + | − | − | + | + | − | − | + | + | − | − |
| − | − | + | + | − | − | + | + | − | − | + | + | − | − | + | + |
| − | − | + | + | − | − | + | + | − | − | + | + | − | − | + | + |
| + | + | − | − | + | + | − | − | + | + | − | − | + | + | − | − |
| + | + | − | − | + | + | − | − | + | + | − | − | + | + | − | − |
| − | − | + | + | − | − | + | + | − | − | + | + | − | − | + | + |
| − | − | + | + | − | − | + | + | − | − | + | + | − | − | + | + |

H2D & V6D

| | | | | | | | | | | | | | | | |
|---|---|---|---|---|---|---|---|---|---|---|---|---|---|---|---|
| + | + | − | − | + | + | − | − | + | + | − | − | + | + | − | − |
| + | + | − | − | + | + | − | − | + | + | − | − | + | + | − | − |
| + | + | − | − | + | + | − | − | + | + | − | − | + | + | − | − |
| + | + | − | − | + | + | − | − | + | + | − | − | + | + | − | − |
| + | + | − | − | + | + | − | − | + | + | − | − | + | + | − | − |
| + | + | − | − | + | + | − | − | + | + | − | − | + | + | − | − |
| − | − | + | + | − | − | + | + | − | − | + | + | − | − | + | + |
| − | − | + | + | − | − | + | + | − | − | + | + | − | − | + | + |
| − | − | + | + | − | − | + | + | − | − | + | + | − | − | + | + |
| − | − | + | + | − | − | + | + | − | − | + | + | − | − | + | + |
| − | − | + | + | − | − | + | + | − | − | + | + | − | − | + | + |
| − | − | + | + | − | − | + | + | − | − | + | + | − | − | + | + |
| + | + | − | − | + | + | − | − | + | + | − | − | + | + | − | − |
| + | + | − | − | + | + | − | − | + | + | − | − | + | + | − | − |
| + | + | − | − | + | + | − | − | + | + | − | − | + | + | − | − |
| + | + | − | − | + | + | − | − | + | + | − | − | + | + | − | − |

| | | | | | | | | |
|---|---|---|---|---|---|---|---|---|
| B | B | B | B | B | B | B | B | L1 |
| B | B | B | B | B | B | B | B | L2 |
| B | B | B | B | B | B | B | B | L3 |
| W | W | W | W | W | W | W | W | L4 |
| W | W | W | W | W | W | W | W | L5 |
| W | W | W | W | W | W | W | W | L6 |
| B | B | B | B | B | B | B | B | L7 |
| B | B | B | B | B | B | B | B | L8 |

H2D & V2D

| | | | | | | | |
|---|---|---|---|---|---|---|---|
| + | + | − | − | + | + | − | − |
| + | + | − | − | + | + | − | − |
| − | − | + | + | − | − | + | + |
| − | − | + | + | − | − | + | + |
| + | + | − | − | + | + | − | − |
| + | + | − | − | + | + | − | − |
| − | − | + | + | − | − | + | + |
| − | − | + | + | − | − | + | + |

Frame inversion

| | | | | | | | |
|---|---|---|---|---|---|---|---|
| + | + | + | + | + | + | + | + |
| + | + | + | + | + | + | + | + |
| + | + | + | + | + | + | + | + |
| + | + | + | + | + | + | + | + |
| + | + | + | + | + | + | + | + |
| + | + | + | + | + | + | + | + |
| + | + | + | + | + | + | + | + |
| + | + | + | + | + | + | + | + |

H2D & V2D

| | | | | | | | |
|---|---|---|---|---|---|---|---|
| − | − | + | + | − | − | + | + |
| − | − | + | + | − | − | + | + |
| + | + | − | − | + | + | − | − |
| + | + | − | − | + | + | − | − |
| − | − | + | + | − | − | + | + |
| − | − | + | + | − | − | + | + |
| + | + | − | − | + | + | − | − |
| + | + | − | − | + | + | − | − |

Frame inversion

| | | | | | | | |
|---|---|---|---|---|---|---|---|
| − | − | − | − | − | − | − | − |
| − | − | − | − | − | − | − | − |
| − | − | − | − | − | − | − | − |
| − | − | − | − | − | − | − | − |
| − | − | − | − | − | − | − | − |
| − | − | − | − | − | − | − | − |
| − | − | − | − | − | − | − | − |
| − | − | − | − | − | − | − | − |

LIQUID CRYSTAL DISPLAY DEVICE AND DRIVING METHOD THEREOF

CROSS-REFERENCE TO RELATED APPLICATION

This applications claim priority under 35 U.S.C. 119 to Korean Patent Application Nos. 10-2009-0041900, filed on May 13, 2009, which are hereby incorporated by reference in their entirety.

BACKGROUND

1. Field of the Disclosure

This disclosure relates to a liquid crystal display device adapted to prevent the generation of noise, and a driving method thereof.

2. Description of the Related Art

The application fields of liquid crystal display (LCD) devices are expanding due to desirable features such as light weight, slimness, and low driving voltage. This trend is evident in the ways in which the LCD devices are being applied to office automation equipment, audio equipment, video equipment, and so on.

An LCD device controls the light transmission of liquid crystal in a state between liquid (or isotropic) and crystalline in accordance with an applied voltage and converts an electric signal into visual information, in order to display an image. To this end, the LCD device includes two substrates having electrodes and a liquid crystal layer interposed between the substrates. Such an LCD device is light weight and has a small volume and is driven by low electric power, in comparison with other display devices of the same size.

The LCD device selectively transmits light emitted from a light source in its rear side portion using pixels on a liquid crystal panel in its front side portion, thereby displaying an image. In other words, the LCD device controls the intensity of light from the light source, unlike a cathode ray tube (CRT) of the related art, which adjusts the intensity of cathode rays in order to display an image.

FIG. 1 is an equivalent circuit diagram showing a pixel on an LCD device of the related art. As shown in FIG. 1, a pixel of the related art LCD device includes a thin film transistor TFT at an intersection of gate and data lines GL1 and DL1 and a storage capacitor Cst connected parallel to a liquid crystal cell Clc. The storage capacitor Cst maintains a data voltage charged into the liquid crystal cell Clc.

The related art LCD device with such a pixel is generally driven in an inversion system which forces a polarity inversion of a desired format, thereby reducing the deterioration of liquid crystal. The inversion system is classified as a frame inversion system, a line inversion system, a dot inversion system, or other systems according to the desired formats.

FIG. 2 is a view explaining a horizontal 2-dot and vertical 2-dot inversion system applied to the related art LCD device. FIG. 3 is a view showing a specific pattern of vertically arranged white-black (hereinafter, a vertical alternating white-black pattern). FIG. 4 is a waveform diagram showing a data voltage applied from the first data line DL1 to the liquid crystal cells when the vertical alternating white-black pattern is displayed.

As shown in FIGS. 2 through 4, when the related art LCD device is driven in the horizontal 2-dot and vertical 2-dot inversion system and the vertical alternating white-black pattern is displayed in which a black gray-scale B and a white gray-scale W are arranged to alternate with each other in three lines, noise is generated from the related art LCD device.

In order to drive the LCD device in the horizontal 2-dot and vertical 2-dot inversion system, a polarity control signal POL which enables data voltages to be inverted every 2 pixels in both horizontal and vertical directions is previously provided.

When the LCD device driven in the horizontal 2-dot and vertical 2-dot inversion system displays the vertical alternating white-black pattern in which three lines of the black gray-scale B and three lines of the white gray-scale W alternate with each other, the black gray-scale data voltages applied to the liquid crystal cells on a second line L2 and a third line L3 of the vertical direction have contrary polarities.

As such, the voltage difference between a positive black gray-scale data voltage +B and a negative black gray-scale data voltage −B becomes greater in a polarity inversion interval S including the second and third lines L2 and L3. Therefore, the related art LCD device causes elements included in a drive circuit of the liquid crystal cells to tremble (or vibrate). In this case, the difference between positive and negative voltage levels for the black gray-scale is established to have a relatively large value, while the voltage difference between positive and negative data voltages for the white gray-scale is established to have a relatively small value.

In other words, when a specific pattern is displayed in which at least three lines of black gray-scale and at least three lines of white gray-scale alternate with each other, the related art LCD device causes circuit elements (for example, a capacitor) driving the liquid crystal cells to tremble (or vibrate) during the polarity inversion interval S which allows black gray-scale data voltage with a large difference of positive and negative voltage levels to be polarity-inverted. As a result, the disadvantage of such a device is the generation of noise.

BRIEF SUMMARY

Accordingly, the present embodiments are directed to an LCD device that substantially obviates one or more of problems due to the limitations and disadvantages of the related art, and a driving method thereof.

An object of the present embodiment is to provide an LCD device that is adapted to prevent the generation of noise, and a driving method thereof.

Additional features and advantages of the embodiments will be set forth in the description which follows, and in part will be apparent from the description, or may be learned by practice of the embodiments. The advantages of the embodiments will be realized and attained by the structure particularly pointed out in the written description and claims hereof as well as the appended drawings.

According to one general aspect of the present embodiment, an LCD device includes: a liquid crystal panel configured to include a plurality of liquid crystal cells formed in regions which are defined by crossing a plurality of gate lines and a plurality of data lines; an image analyzer configured to analyze whether or not an image data corresponds to a specific pattern in which a black gray-scale data having a large difference between positive and negative data voltages is continuously opposed to the liquid crystal cells of a vertical direction; a polarity control signal modulator configured to respond to a control signal from the image analyzer and modulate a polarity control signal, so as to prevent the black or white gray-scale data continuously opposed to the liquid crystal cells of the vertical direction from being polarity-inverted; and a data driver configured to apply the data voltages to the data lines on the liquid crystal panel on the basis of the modulated polarity control signal applied from the polarity control signal modulator.

A method of driving an LCD device according to another aspect of the present embodiment includes: analyzing whether or not an image data corresponds to a specific pattern in which a black or white gray-scale data having a large difference between positive and negative data voltages is continuously opposed to pixels of a vertical direction; modulating a polarity control signal to prevent the black or white gray-scale data from being polarity-inverted when the image data corresponds to the specific pattern in which the black or white gray-scale data is continuously opposed to the pixels of the vertical direction; and applying the data voltages to the pixels using the modulated polarity control signal.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated in and constitute a part of this application, illustrate embodiment(s) of the invention and together with the description serve to explain the disclosure. In the drawings:

FIG. 11 is a view showing a vertical alternating white-black pattern which is used in an LCD device according to another embodiment of the present disclosure;

FIG. 12 is a view explaining a driving method of the LCD device according to another embodiment of the present disclosure using a modulated and divided polarity control signal when the vertical alternating white-black pattern of FIG. 11 is displayed;

DETAILED DESCRIPTION

Figures 1, 2, 3:
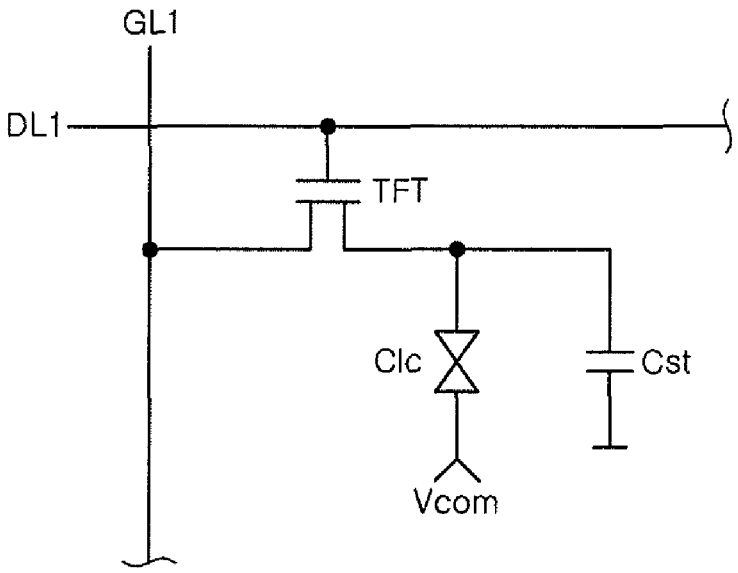
FIG. 1 (Related Art)
FIG. 2 (Related Art)
FIG. 3 (Related Art)
FIG. 1 is an equivalent circuit diagram showing a pixel on an LCD device of the related art.
FIG. 2 is a view explaining a horizontal 2-dot and vertical 2-dot inversion system applied to the related art LCD device.
FIG. 3 is a view showing a vertical alternating white-black pattern.
Figure 4:
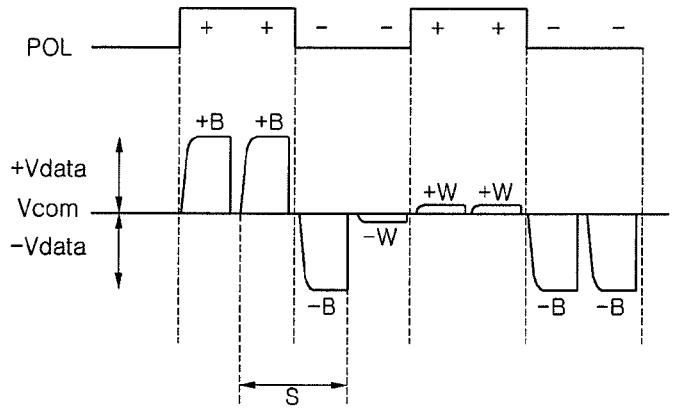
FIG. 4 (Related Art)
FIG. 4 is a waveform diagram showing a data voltage applied from a first data line to pixels when the vertical alternating white-black pattern of FIG. 3 is displayed.

Reference will now be made in detail to the embodiments of the present disclosure, examples of which are illustrated in the accompanying drawings. These embodiments introduced hereinafter are provided as examples in order to convey their spirits to the ordinary skilled person in the art. Therefore, these embodiments might be embodied in a different shape, so are not limited to these embodiments described here. Also, the size and thickness of the device might be expressed to be exaggerated for the sake of convenience in the drawings. Wherever possible, the same reference numbers will be used throughout this disclosure including the drawings to refer to the same or like parts.

Figure 5:
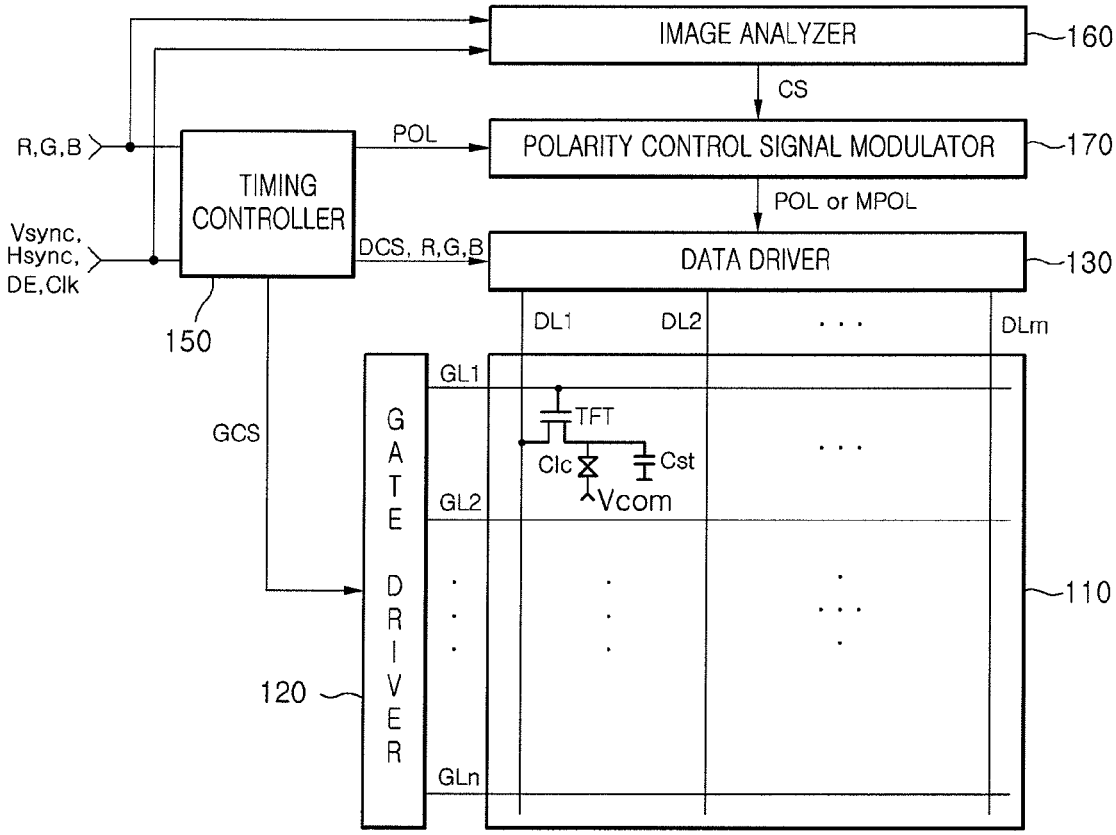
FIG. 5 is a schematic diagram showing an LCD device according to an embodiment of the present disclosure.
Figures 6, 7, 8:
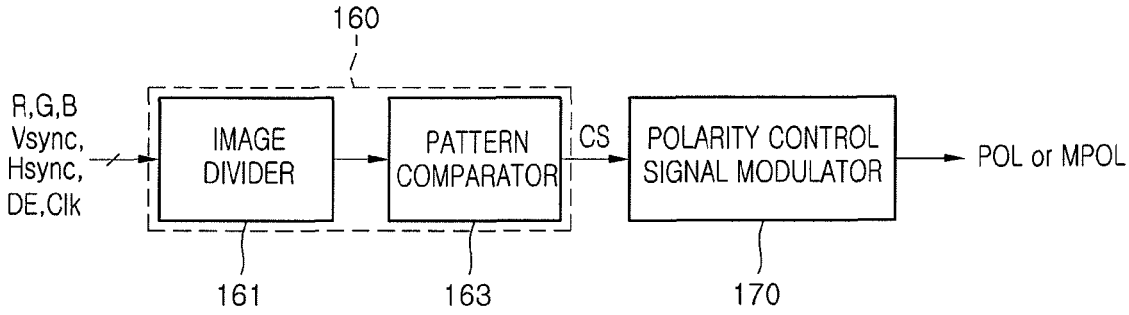
FIG. 6 is a view showing an image analyzer and a polarity control signal modulator according to an embodiment of the present disclosure.
FIG. 7 is a view showing a vertical alternating white-black pattern which is used in an LCD device according to an embodiment of the present disclosure.
FIG. 8 is a view explaining a driving method of the LCD device according to an embodiment of the present disclosure using a modulated polarity control signal when the vertical alternating white-black pattern of FIG. 7 is displayed.

FIG. 5 is a schematic diagram showing an LCD device according to an embodiment of the present disclosure. FIG. 6 is a view showing an image analyzer and a polarity control signal modulator according to an embodiment of the present disclosure.

Referring to FIGS. 5 and 6, an LCD device according to an embodiment of the present disclosure includes: a liquid crystal panel 110 configured to include thin film transistors TFT each formed at intersections of gate lines GL1~GLn and data lines DL1~DLm: a gate driver 120 configured to apply scan signals to the gate lines GL1~GLn on the liquid crystal panel 110; a data driver 130 configured to apply data signals to the data lines DL1~DLm on the liquid crystal panel 110; and a timing controller 150 configured to control the gate driver 120 and the data driver 130. The thin film transistors TFT drive liquid crystal cells Clc, respectively. The LCD device further includes an image analyzer 160 configured to respond to a control signal from the timing controller 150 and to analyze the pattern of data voltages applied to the liquid crystal panel 110, and a polarity control signal modulator 170 configured to respond to a control signal CS from the image analyzer 160 and to apply either a polarity control signal POL or a modulated polarity control signal MPOL to the data driver 130. Although it is not shown in drawings, the LCD device also includes a common voltage generator configured to generate a common voltage Vcom and a power supply unit configured to apply power supply voltages to the respective components.

The liquid crystal panel 110 is divided into pixel regions by the intersection of the plurality of gate lines GL1~GLn and the plurality of data lines DL1~DLm, and each of the thin film transistors TFT is formed in a respective pixel region. Each of the pixel regions includes a liquid crystal cell Clc connected to the respective thin film transistor TFT. The liquid crystal cell Clc is configured to include a pixel electrode connected to a gate electrode of the respective thin film transistor TFT and a common electrode disposed opposite to the pixel electrode with a liquid crystal in the center. Each of the thin film transistors TFT responds to the scan signal from the respective gate line GL and applies the data signal from the respective data line DL to the respective pixel electrode. Then, the liquid crystal cell CIc charges a different voltage between the data signal applied to the pixel electrode and the common voltage Vcom applied to the common electrode. Also, the liquid crystal cell Clc changes the molecular alignment of the liquid crystal along the charged voltage and adjusts the light transmissivity of the liquid crystal, thereby realizing gray-scales. Furthermore, each of the pixel regions includes a storage capacitor Cst connected parallel to the liquid crystal cell Clc. The storage capacitor Cst maintains the voltage charged in the liquid crystal capacitor Clc until the data signal is again applied.

The gate driver 120 sequentially generates a plurality of scan pulses using gate drive control signals GCS applied from the timing controller 150. Also, the gate driver 120 sequentially supplies the plurality of scan pulses to the gate lines GL1~GLn.

The data driver 130 responds to data drive control signals DCS applied from the timing controller 150 and supplies a plurality of data signals to the data lines DL1~DLm. The data driver 130 samples and latches image data R, G, and B input from the timing controller 150. The data driver 130 then converts the latched image data into the data signals of an analog voltage shape using a gamma reference voltage set from a gamma reference voltage generator (not shown) via a gamma reference voltage selector (not shown). The data signals of an analog voltage shape allow the liquid crystal cell CIc to display the gray-scales. Also, the data signals of an analog voltage shape are applied to the data lines DL1~DLm on the liquid crystal panel 110.

The image analyzer 160 analyzes the pattern of the image data to be displayed on the liquid crystal panel 110. To this end, the image analyzer 160 is configured to include an image divider 161 and a pattern comparator 163, as shown in FIG. 6. The image divider 161 receives the image data R, G, and B, a horizontal synchronous signal Hsync, a vertical synchronous signal Vsync, the data enable signal DE, and the clock signal CLK from the timing controller 150. Also, the image divider 161 divides the image data R, G, and B in one frame of image data (i.e., a series of frame image data) using the horizontal synchronous signal Hsync, the vertical synchronous signal Vsync, the data enable signal DE, and the clock signal CLK. The pattern comparator 163 detects whether or not the frame image data from the image divider 161 corresponds to a specific pattern. To this end, the pattern comparator 163 compares the frame image data from the image divider 161 with the specific pattern data. Also, the pattern comparator 163 generates the control signal CS on the basis of the compared resultant and applies the control signal CS to the polarity control signal modulator 170.

The specific pattern may depend on the inversion-driving system (for example, a horizontal 2-dot and vertical 2-dot inversion system) of an LCD device and may be a cyclically repeated pattern in which one gray-scale (i.e., a black gray-scale) having a large difference between its positive data voltage and its negative data voltage is periodically repeated in the vertical direction. For example, if the LCD device of the present embodiment is driven in a horizontal 2-dot and vertical 2-dot inversion system, the specific pattern can be a vertically repeated black pattern in which the image data of a black gray-scale is continuously repeated every at least 3 pixels in the vertical direction. Such a specific pattern data may be stored in either the pattern comparator 162 or a separated memory (not shown).

Although the LCD device of the present embodiment refers to the black gray-scale as a gray-scale having a large difference between its positive and negative data voltages, the black gray-scale is used in the LCD device of a vertical electric field system like a twisted nematic mode. Alternatively, the LCD device of present embodiment is a horizontal electric field system like an in-plane switching mode. In this case, a white gray-scale may be used as a gray-scale having a large difference between its positive and negative data voltages.

The polarity control signal modulator 170 responds to the control signal CS from the image analyzer 160 (more specifically, the pattern comparator 163) and applies either the polarity control signal POL or the modulated polarity control signal MPOL to the data driver 130. More specifically, the polarity control signal modulator 170 modulates the polarity control signal POL and applies the modulated polarity control signal MPOL to the data driver 130, when the image analyzer 160 (i.e., the pattern comparator 163) determines that the frame image data corresponds to the specific pattern. On the other hand, the polarity control signal modulator 170 originally applies the polarity control signal POL to the data driver 130 in case the frame image data does not correspond to the specific pattern.

In the LCD device of the present embodiment, the modulated polarity control signal MPOL generated by means of the image analyzer 160 and the polarity control signal modulator 170 prevents the vibrations of circuit components due to a large difference between the positive and negative data voltages for the same gray-scale, as well as the generation of noise caused by the vibrations of the circuit components. This results from the fact that the different polarities of black gray-scale data voltages to be applied to the adjacent pixels in the vertical direction are changed into the same polarity by means of the data driver 130 receiving the modulated polarity control signal MPOL. In other words, the LCD device of the present embodiment enables the black gray-scale having the large difference between its positive and negative voltages to be realized by adjacent pixels in the vertical direction by means of the same polarity data voltages using the modulated polarity control signal MPOL, when the image of a vertical alternating white-black pattern is displayed.

FIG. 7 is a view showing a vertical alternating white-black pattern. Also, FIG. 8 is a view explaining a driving method of the LCD device according to an embodiment of the present disclosure using a modulated polarity control signal when the vertical alternating white-black pattern of FIG. 7 is displayed. Furthermore, FIG. 9 is a waveform diagram showing a data voltage applied from first data line to the liquid crystal cells when the vertical white-black pattern of FIG. 7 is displayed.

Figure 9:
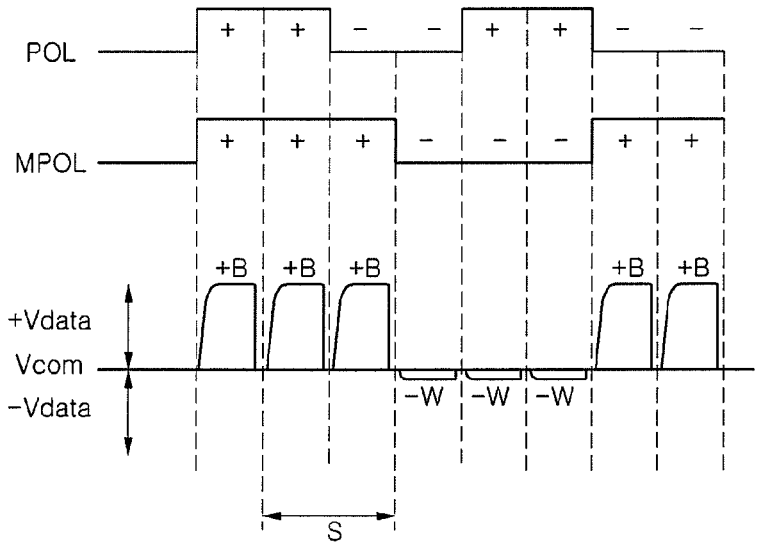
FIG. 9 is a waveform diagram showing a data voltage applied from a first data line to pixels when the vertical alternating white-black pattern of FIG. 7 is displayed.

As shown in FIGS. 7 to 9, the specific pattern can become a vertical alternating white-black pattern in which a white gray-scale and a black gray-scale are repeatedly and alternately arranged by three lines in the vertical direction.

The polarity control signal modulator 170 modulates the polarity control signal POL and generates the modulated polarity control signal MPOL adapted to be used in a horizontal 2-dot and vertical 3-dot inversion system, when an image of the vertical alternating white-black pattern is displayed on a liquid crystal panel 110 which is driven in the horizontal 2-dot and vertical 2-dot inversion system. The modulated polarity control signal MPOL is applied to the data driver 130.

Although data voltages of the black gray-scale B, which has a large difference between its positive and negative voltages, are opposite to the adjacent pixels of vertical direction on first through third lines L1~L3, the modulated polarity control signal MPOL generated in the polarity control signal modulator 170 enables the data driver 130 to apply the black gray-scale data voltages of a positive polarity to the adjacent pixels of vertical direction on the first to third lines L1~L3. In other words, the LCD device of the present embodiment forces the same polarity data voltages to be applied in the polarity inversion interval "S" by means of the modulated polarity control signal MPOL.

In this manner, the LCD device of the present embodiment is driven in a vertical 3-dot inversion system by the modulated polarity control signal MPOL. As such, the data voltage of black gray-scale voltage which has a large difference between its positive and negative voltage does not become polarity-inverted, when an image of the vertical 3-dot alternating white-black pattern is displayed. Therefore, the LCD device of the present embodiment can prevent the generation of noise due to the difference between the positive and negative data voltages.

In order to reduce more of the vibrations of circuit components caused by the difference between the data voltages as well as more of the noise due to the vibrations of the circuit components, an LCD device according another embodiment of present disclosure is proposed. The LCD device of another embodiment can have a configuration that a frequency divider is further included in the LCD device of an embodiment shown in FIG. 5. The frequency divider can be connected between the polarity control signal modulator 170 and the data driver 130. Such an LCD device according to another embodiment of the present disclosure will now be described in detail referring to FIGS. 10 through 13.

Figure 10:
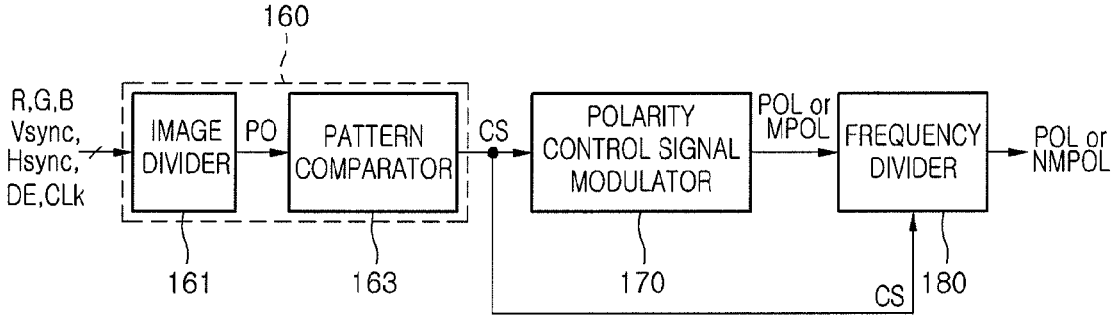
FIG. 10 is a view showing an image analyzer, a polarity control signal modulator, and a frequency divider which are included in an LCD device according to another embodiment of the present disclosure.
Figure 13:
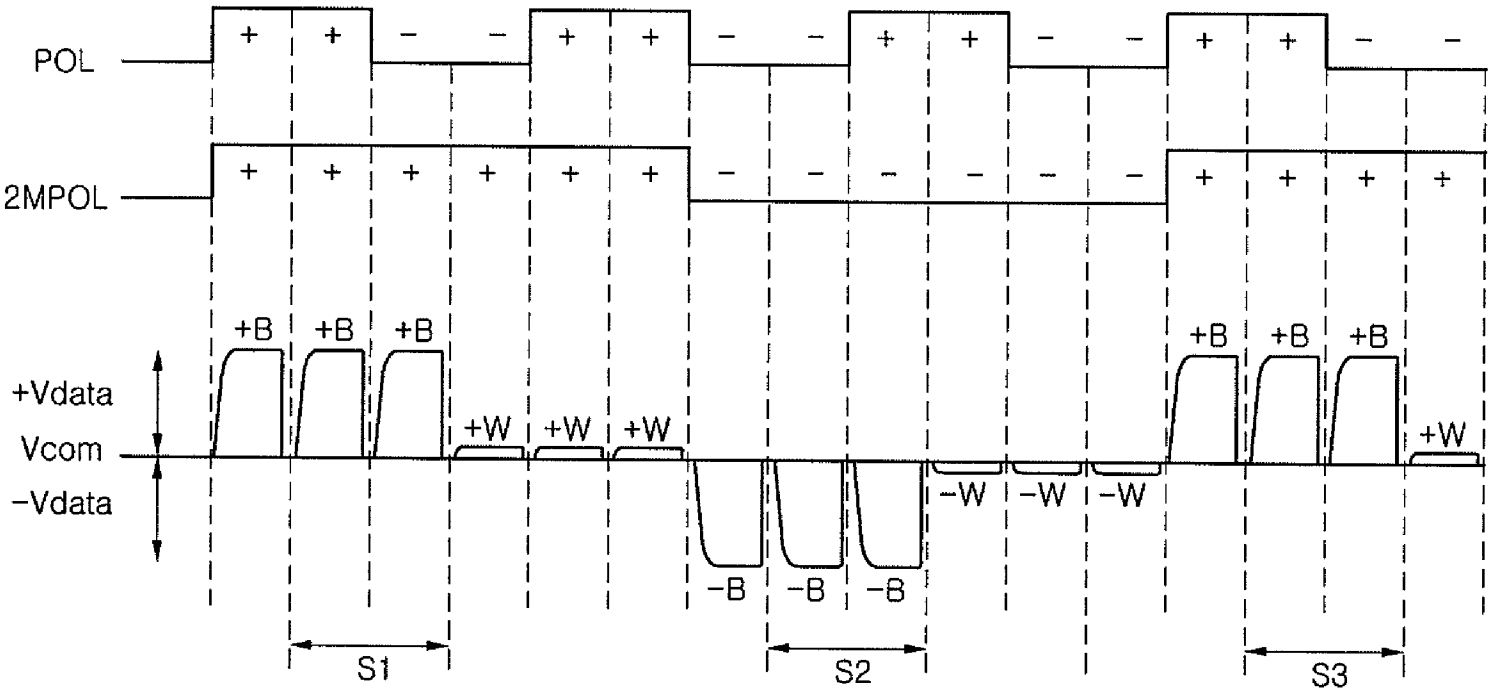
FIG. 13 is a waveform diagram showing a data voltage applied from a first data line to pixels when the vertical alternating white-black pattern of FIG. 11 is displayed.

FIG. 10 is a view showing an image analyzer, a polarity control signal modulator, and a frequency divider according to another embodiment of the present disclosure, and FIG. 11 is a view showing a vertical alternating white-black pattern which is used in an LCD device according to another embodiment of the present disclosure. Also, FIG. 12 is a view explaining a driving method of the LCD device according to another embodiment of the present disclosure using a modulated polarity control signal when the vertical alternating white-black pattern of FIG. 11 is displayed. Furthermore, FIG. 13 is a waveform diagram showing a data voltage applied from first data line to the liquid crystal cells, a polarity control signal, and a modulated and divided polarity control signal when the vertical white-black pattern of FIG. 11 is displayed.

Referring to FIGS. 10 through 13, the image analyzer 160 included in the LCD device of the present embodiment analyzes the pattern of an image data to be displayed on the liquid crystal panel 110. To this end, the image analyzer 160 is configured to include an image divider 161 and a pattern comparator 163, as shown in FIG. 6. The image divider 161 receives the image data R, G, and B, a horizontal synchronous signal Hsync, a vertical synchronous signal Vsync, the data enable signal DE, and the clock signal CLK from the timing controller 150. Also, the image divider 161 divides the image data R, G, and B in one frame of image data (i.e., a series of frame image data) PO using the horizontal synchronous signal Hsync, the vertical synchronous signal Vsync, the data enable signal DE, and the clock signal CLK. The pattern comparator 163 detects whether or not the frame image data PO from the image divider 161 corresponds to a specific pattern. To this end, the pattern comparator 163 compares the frame image data PO from the image divider 161 with the specific pattern data. Also, the pattern comparator 163 generates the control signal CS on the basis of the compared resultant and applies the control signal CS to the polarity control signal modulator 170.

The specific pattern may depend on the inversion-driving system of an LCD device and may be a cyclically repeated pattern in which one gray-scale (i.e., black gray-scale) having a large difference between its positive data voltage and its negative data voltage is periodically repeated in the vertical direction. For example, if the LCD device of the present embodiment is driven in a horizontal 2-dot and vertical 2-dot inversion system, the specific pattern can be a vertically repeated black pattern in which the image data of a black gray-scale is repeated every 3 pixels in the vertical direction. Such a specific pattern data may be stored in either the pattern comparator 162 or a separated memory (not shown).

The polarity control signal modulator 170 responds to the control signal CS from the image analyzer 160 (more specifically, the pattern comparator 163) and applies either the polarity control signal POL or the modulated polarity control signal MPOL to the data driver 130. More specifically, the polarity control signal modulator 170 modulates the polarity control signal POL and applies the modulated polarity control signal MPOL to the data driver 130, when the image analyzer 160 (i.e., the pattern comparator 163) determines that the frame image data corresponds to the specific pattern. On the other hand, the polarity control signal modulator 170 originally applies the polarity control signal POL to the data driver 130 in case the frame image data does not correspond to the specific pattern.

The LCD device according to another embodiment of the present disclosure further includes a frequency divider 180 configured to frequency-divide the modulated polarity control signal MPOL from the polarity control signal modulator 170. The frequency divider 180 frequency-divides the modulated polarity control signal MPOL with at least 2 and applies the modulated and divided polarity control signal NMPOL to the data driver 130. Preferably, the frequency divider 180 frequency-divides the modulated polarity control signal MPOL with "2", in order to minimize the vibrations of circuit components caused by the difference between the data voltages and likewise limit more of the noise due to the vibrations of the circuit components. The frequency divider 180 responds to the control signal from the pattern comparator 163 so that only the modulated polarity control signal MPOL is frequency-divided. In other words, the frequency divider 180 frequency-divides the modulated polarity control signal from the polarity control signal modulator 170 when the image analyzer 160 (i.e., the pattern comparator 163) determines that the frame image data corresponds to the specific pattern. On the other hand, the frequency divider 180 originally applies the polarity control signal POL from the polarity control signal modulator 170 to the data driver 130, in case the frame image data does not correspond to the specific pattern.

The specific pattern can become a vertical alternating white-black pattern in which a white gray-scale and a black gray-scale are repeatedly and alternately arranged by three lines in the vertical direction.

The polarity control signal modulator 170 modulates the polarity control signal POL and generates the modulated polarity control signal MPOL adapted to be used in a horizontal 2-dot and vertical 3-dot inversion system, when an image of the vertical alternating white-black pattern is displayed on a liquid crystal panel 110 which is driven in the horizontal 2-dot and vertical 2-dot inversion system. The modulated polarity control signal MPOL is applied to the data driver 130. The frequency divider 180 frequency-divides the modulated polarity control signal MPOL for the horizontal 2-dot and vertical 2-dot inversion system 2 times and generates the modulated and divided polarity control signal NMPOL adapted to be used in a horizontal 2-dot and vertical 6-dot inversion system.

Although data voltages of the black gray-scale B having a large difference between positive and negative voltages are opposite to the adjacent pixels in a vertical direction on first through third lines L1~L3, the modulated and divided polarity control signal NMPOL generated by the polarity control signal modulator 170 and the frequency divider 180 enables the data driver 130 to apply the black gray-scale data voltages +B of a positive polarity to the adjacent pixels of vertical direction in the first to third lines L1~L3. In other words, the LCD device according to another embodiment of the present disclosure forces the same polarity data voltages to be applied in the polarity inversion intervals S1~S3 by means of the modulated and divided polarity control signal NMPOL.

In this way, the LCD device according to another embodiment of the present disclosure can be driven in a vertical 6-dot inversion system by the modulated and divided polarity control signal NMPOL. As such, the data voltage of black gray-scale voltage having a large difference between its positive and negative voltage does not become polarity-inverted, when an image of the vertical 3-dot alternating white-black pattern is displayed. Therefore, the LCD device of the present embodiment can prevent the generation of noise due to the difference between the positive and negative data voltages.

In addition, the data voltages sequentially applied to the pixels on a vertical line have a positive (or negative) low absolute level (i.e., the white gray-scale data voltage W) before they are inverted from the positive (or negative) high absolute voltage level (i.e., the positive (or negative) black gray-scale data voltage +B (or −B)) to the negative (or positive) high absolute level (i.e., the negative (or positive) black gray-scale data voltage −B (or +B)). As such, the LCD device according to another embodiment of the present disclosure further reduces the difference between the data voltages in comparison with that of the first embodiment. Accordingly, the LCD device according to another embodiment of the present disclosure can minimize the vibrations of circuit components caused by the difference between the data voltages, as well as the noise due to the vibrations of the circuit components.

Figures 14, 15:
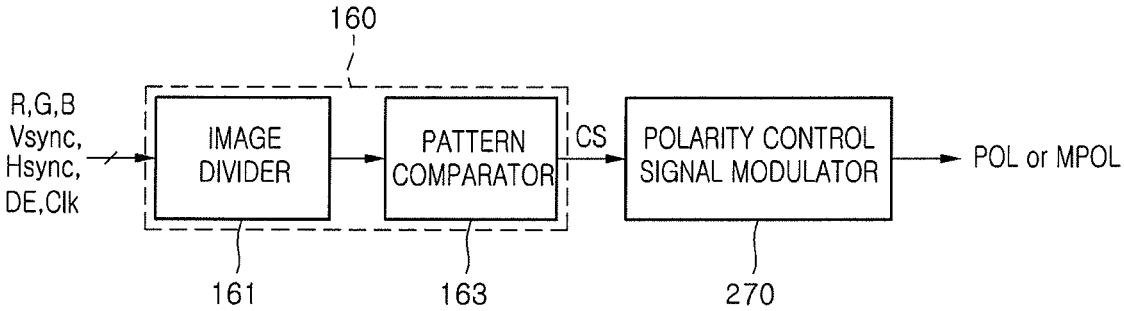
FIG. 14 is a view showing an image analyzer and a polarity control signal modulator which are included in an LCD device according to still another embodiment of the present disclosure.
FIG. 15 is a view showing a vertical alternating white-black pattern which is used in an LCD device according to still another embodiment of the present disclosure.
Figures 16, 17:
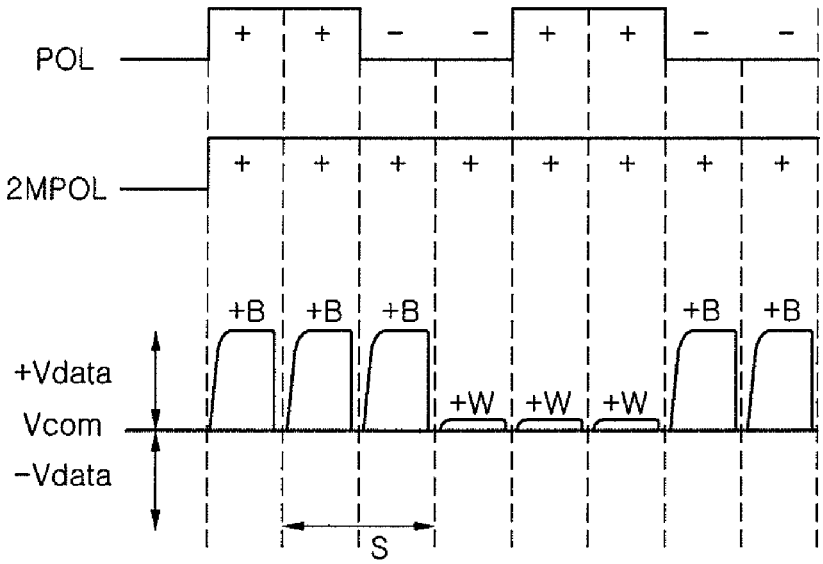
FIG. 16 is a view explaining a driving method of the LCD device according to another embodiment of the present disclosure using a modulated and divided polarity control signal when the vertical alternating white-black pattern of FIG. 11 is displayed.
FIG. 17 is a waveform diagram showing a data voltage applied from a first data line to pixels when the vertical alternating white-black pattern of FIG. 15 is displayed.

FIG. 14 is a view showing an image analyzer and a polarity control signal modulator which are included in an LCD device according to still another embodiment of the present disclosure. FIG. 15 is a view showing a vertical alternating white-black pattern which is used in an LCD device according to still another embodiment of the present disclosure. FIG. 16 is a view explaining a driving method of the LCD device according to another embodiment of the present disclosure using a modulated and divided polarity control signal when the vertical alternating white-black pattern of FIG. 11 is displayed. FIG. 17 is a waveform diagram showing a data voltage applied from a first data line to pixels when the vertical alternating white-black pattern of FIG. 15 is displayed.

Referring to FIGS. 14 through 16, an image analyzer 160 included in the LCD device of the present embodiment analyzes the pattern of an image data to be displayed on the liquid crystal panel 110. To this end, the image analyzer 160 is configured to include an image divider 161 and a pattern comparator 163, as shown in FIG. 14. The image divider 161 receives the image data R, G, and B, a horizontal synchronous signal Hsync, a vertical synchronous signal Vsync, a data enable signal DE, and a clock signal CLK from a timing controller 150. Also, the image divider 161 divides the image data R, G, and B into one frame of image data (i.e., a series of frame image data) PO using the horizontal synchronous signal Hsync, the vertical synchronous signal Vsync, the data enable signal DE, and the clock signal CLK. The pattern comparator 163 detects whether or not the frame image data PO from the image divider 161 corresponds to a specific pattern. To this end, the pattern comparator 163 compares the frame image data PO from the image divider 161 with the specific pattern data. Also, the pattern comparator 163 generates the control signal CS on the basis of the compared resultant and applies the control signal CS to the polarity control signal modulator 270.

The specific pattern may depend on the inversion-driving system of an LCD device and may be a cyclically repeated pattern in which one gray-scale (i.e., black gray-scale) having a large difference between its positive data voltage and its negative data voltage is periodically repeated in the vertical direction. For example, if the LCD device of the present embodiment is driven in a horizontal 2-dot and vertical 2-dot inversion system, the specific pattern can be a vertically repeated black pattern in which the image data of a black gray-scale is repeated every 3 pixels in the vertical direction. Such a specific pattern data may be stored in either the pattern comparator 162 or a separated memory (not shown).

The polarity control signal modulator 270 responds to the control signal CS from the image analyzer 160 (more specifically, the pattern comparator 163) and applies either the polarity control signal POL or the modulated polarity control signal MPOL to the data driver 130. More specifically, the polarity control signal modulator 270 modulates the polarity control signal POL and applies the modulated polarity control signal MPOL to the data driver 130, when the image analyzer 160 (i.e., the pattern comparator 163) determines that the frame image data corresponds to the specific pattern. On the other hand, the polarity control signal modulator 270 originally applies the polarity control signal POL to the data driver 130 in case the frame image data does not correspond to the specific pattern.

The specific pattern can become a vertical alternating white-black pattern in which a white gray-scale and a black gray-scale are repeatedly and alternately arranged by three lines in the vertical direction.

The polarity control signal modulator 270 modulates the polarity control signal POL and generates the modulated polarity control signal MPOL adapted to be used in a frame inversion driving system, when an image of the vertical alternating white-black pattern is displayed on a liquid crystal panel 110 which is driven in the horizontal 2-dot and vertical 2-dot inversion system. The modulated polarity control signal MPOL is applied to the data driver 130.

Although data voltages of the black gray-scale B having a large difference between positive and negative voltages are opposite to the adjacent pixels in a vertical direction on first through third lines L1~L3, the modulated polarity control signal MPOL generated by the polarity control signal modulator 270 enables the data driver 130 to apply the black gray-scale data voltages +B of a positive polarity to the adjacent pixels of vertical direction in the first to third lines L1~L3. In other words, the LCD device according to another embodiment of the present disclosure forces the same polarity data voltages to be applied in the polarity inversion interval S by means of the modulated polarity control signal MPOL.

In this manner, the LCD device according to still another embodiment of the present disclosure can be driven in a frame inversion system by the modulated polarity control signal MPOL. As such, the data voltage of black gray-scale voltage having a large difference between its positive and negative voltage does not become polarity-inverted, when an image of the vertical 3-dot alternating white-black pattern is displayed. Therefore, the LCD device of the present embodiment can prevent the generation of noise due to the difference between the positive and negative data voltages.

Although the present disclosure has been limitedly explained regarding only the embodiments described above, it should be understood by the ordinary skilled person in the art that the present disclosure is not limited to these embodiments, but rather that various changes or modifications thereof are possible without departing from the spirit of the present disclosure. Accordingly, the scope of the present disclosure shall be determined only by the appended claims and their equivalents.

What is claimed is:

1. A liquid crystal display device comprising:

a liquid crystal panel configured to include a plurality of liquid crystal cells formed in regions which are defined by crossing a plurality of gate lines and a plurality of data lines;

an image analyzer configured to analyze whether or not an image data corresponds to a specific pattern in which a black or white gray-scale data having a large difference between positive and negative data voltages is continuously opposed to the liquid crystal cells of a vertical direction;

a polarity control signal modulator configured to respond to a control signal from the image analyzer and modulate a polarity control signal, so as to prevent the black or white gray-scale data continuously opposed to the liquid crystal cells of the vertical direction from being polarity-inverted; and a data driver configured to apply the data voltages to the data lines on the liquid crystal panel on the basis of the modulated polarity control signal applied from the polarity control signal modulator.

2. The liquid crystal display device claimed as claim 1, wherein the polarity control signal modulator modulates the polarity control signal into a vertical driving system identified with the specific pattern so as to prevent the black or white gray-scale data continuously opposed to the pixels of the vertical direction on the liquid crystal panel from being polarity-inverted.

3. The liquid crystal display device claimed as claim 1, further comprising a frequency divider configured to frequency-divide the modulated polarity control signal output from the polarity control signal modulator.

4. The liquid crystal display device claimed as claim 1, wherein the polarity control signal modulator modulates the polarity control signal into a frame inversion driving system so that the black and white gray-scale data opposed to all the pixels on the liquid crystal panel have the same polarity and are polarity-inverted every frame.

5. The liquid crystal display device claimed as claim 1, wherein the image analyzer includes:

an image divider configured to divide the image data into one frame of image data using a horizontal synchronous signal, a vertical synchronous signal, a data enable signal, and a clock signal, and to analyze a pattern of frame image data applied to the liquid crystal panel; and a comparator configured to compare whether or not a pattern of the frame image data corresponds to the specific pattern.

6. A method of driving a liquid crystal display device, comprising:

analyzing whether or not an image data corresponds to a specific pattern in which a black or white gray-scale data having a large difference between positive and negative data voltages is continuously opposed to pixels of a vertical direction;

modulating a polarity control signal to prevent the black or white gray-scale data from being polarity-inverted when the image data corresponds to the specific pattern in which the black or white gray-scale data is continuously opposed to the pixels of the vertical direction; and applying the data voltages to the pixels using the modulated polarity control signal.

7. The method claimed as claim 6, wherein the polarity control signal is modulated into a vertical driving system identified with the specific pattern so as to prevent the black or white gray-scale data continuously opposed to the pixels of the vertical direction on a liquid crystal panel from being polarity-inverted.

8. The method claimed as claim 6, further comprises frequency-dividing the modulated polarity control signal.

9. The method claimed as claim 6, wherein the polarity control signal is modulates into a frame inversion driving system so that the black and white gray-scale data opposed to all the pixels on the liquid crystal panel have the same polarity and are polarity-inverted every frame.

10. The method claimed as claim 6, wherein the analyzing of the image data includes:

dividing the image data in one frame of image data using a horizontal synchronous signal, a vertical synchronous signal, a data enable signal, and a clock signal, and to analyze a pattern of frame image data applied to a liquid crystal panel; and comparing whether or not a pattern of the frame image data corresponds to the specific pattern.

* * * * *